US008191963B2

(12) United States Patent
Gamboa

(10) Patent No.: US 8,191,963 B2
(45) Date of Patent: Jun. 5, 2012

(54) STACKABLE CHAIR

(76) Inventor: Gustavo G. Gamboa, Tinley Park, IL (US)

( * ) Notice: Subject to any disclaimer, the term of this patent is extended or adjusted under 35 U.S.C. 154(b) by 286 days.

(21) Appl. No.: 12/639,511

(22) Filed: Dec. 16, 2009

(65) Prior Publication Data

US 2011/0049944 A1 Mar. 3, 2011

Related U.S. Application Data

(60) Provisional application No. 61/275,189, filed on Aug. 26, 2009.

(51) Int. Cl.
*A47C 7/62* (2006.01)

(52) U.S. Cl. ..... 297/188.14; 297/239; 297/451.12

(58) Field of Classification Search ..... 297/188.14, 297/188.18, 239, 451.12
See application file for complete search history.

(56) References Cited

U.S. PATENT DOCUMENTS

| | | | | |
|---|---|---|---|---|
| 3,233,940 | A * | 2/1966 | Tooley, Jr. | 297/188.18 |
| 4,798,413 | A * | 1/1989 | Capelli | 297/161 |
| D361,915 | S * | 9/1995 | Zinnbauer | D6/501 |
| 5,641,197 | A * | 6/1997 | Springmann | 297/188.11 |
| 6,059,357 | A * | 5/2000 | Peart | 297/173 |
| 6,439,659 | B1 * | 8/2002 | Neubauer, Jr. | 297/188.01 |
| 6,840,574 | B1 * | 1/2005 | Wu | 297/45 |
| 7,243,991 | B2 * | 7/2007 | Ojeda | 297/188.14 |
| 7,530,632 | B2 * | 5/2009 | Kaloustian et al. | 297/188.14 |
| 2006/0138814 | A1 * | 6/2006 | Burbrink | 297/188.14 |
| 2010/0301644 | A1 * | 12/2010 | Adams et al. | 297/183.1 |

* cited by examiner

*Primary Examiner* — Peter R. Brown
(74) *Attorney, Agent, or Firm* — Schiff Hardin LLP

(57) ABSTRACT

In a stackable chair system, a plurality of chairs are provided, each chair having a back, a seat, and first and second armrests all integral with one another in an injection-molded thermal plastic construction. Each first armrest has an integral molded round cup-holder positioned in a region of an outer end of the first armrest. Each second armrest has an integral molded plate-holder in a region of an outer end of the second armrest. Each seat portion is contoured downwardly forming a seat depression. Each chair is dimensioned so that the chairs can be stacked on top of one another in nested fashion.

15 Claims, 2 Drawing Sheets

STACKABLE CHAIR

RELATED APPLICATION

The present application claims the benefit of the filing date of U.S. provisional patent application titled: "Stackable Chair", Ser. No. 61/275,189 filed Aug. 26, 2009, inventor Gustavo G. Gamboa.

BACKGROUND

The preferred embodiments relate generally to a stackable chair and, more particularly, the preferred embodiments relate to a stackable chair featuring a molded cup-holder built into a left-hand armrest and a plate-holder built into a right-hand armrest.

Inexpensive, molded plastic lawn or patio chairs are used for outdoor events and gatherings. These stackable, one-piece chairs have become standard equipment for consumer households as well as a wide variety of organizations, institutions, and establishments ranging from bars and caterers to schools and churches. The molded stackable chairs are lightweight and inexpensive, easy to move and store, and quite durable for the price. But, when used for events at which food and drink are served and consumed, the standard design of such chairs comes up short. Attempting to enjoy a plate of barbecue and a soft drink while sitting in such a chair, the guest must hold the plate in his or her lap, and either hold the drink or set it on the ground. As a result, drinks and plates get spilled, guests' clothing gets soiled, and the entire event becomes less enjoyable than it might have been.

SUMMARY

In a stackable chair system, a plurality of chairs are provided, each chair having a back, a seat, and first and second armrests all integral with one another in an injection-molded thermal plastic construction. Each first armrest has an integral molded round cup-holder positioned in a region of an outer end of the first armrest. Each second armrest has an integral molded plate-holder in a region of an outer end of the second armrest. Each seat portion is contoured downwardly forming a seat depression. Each chair is dimensioned so that the chairs can be stacked on top of one another in nested fashion.

DESCRIPTION OF THE PREFERRED EMBODIMENTS

Figure 2:
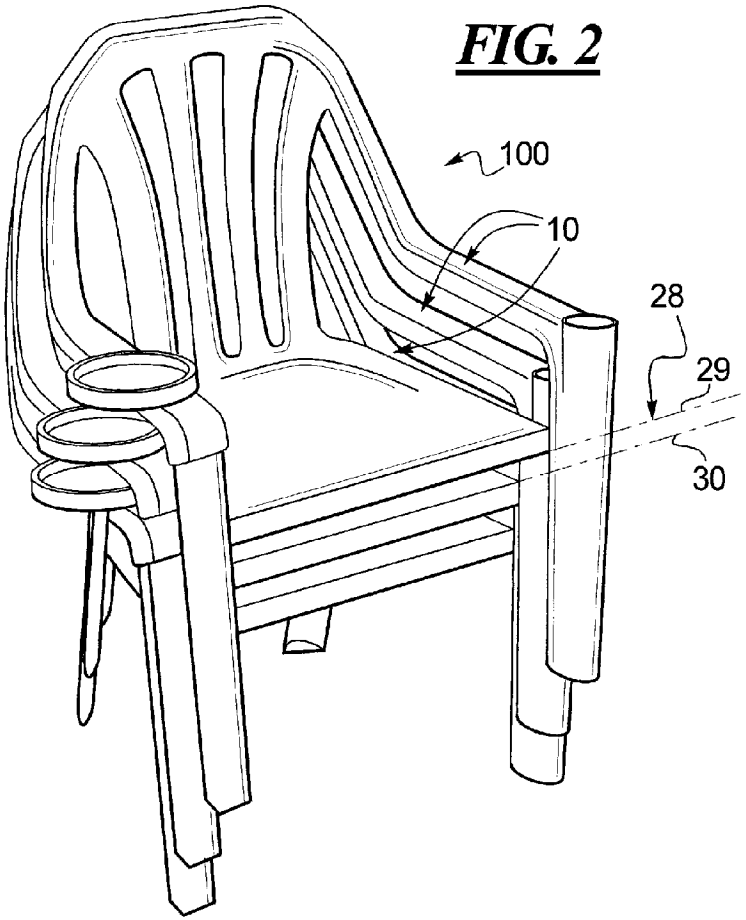
FIG. 2 is a perspective view of a stack of the stackable chairs according to the preferred embodiment of FIG. 1.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

Figure 1:
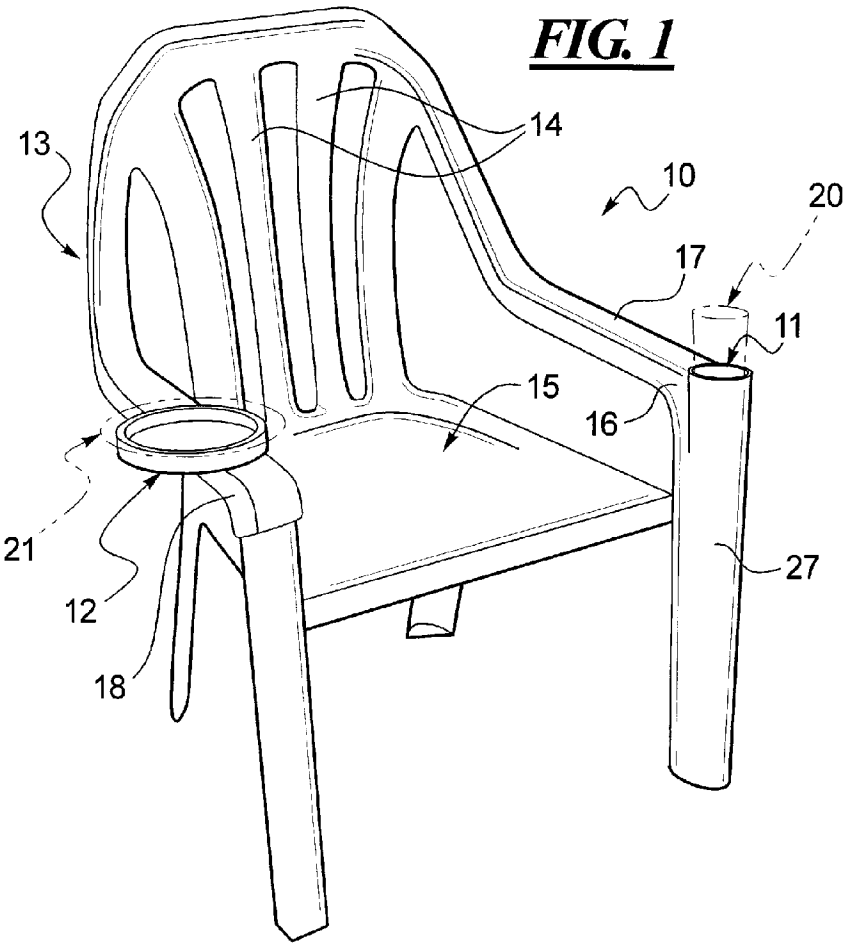
FIG. 1 is a perspective view illustrating a stackable chair, constructed in accordance with a preferred embodiment.

As illustrated in FIG. 1, the present preferred embodiment is a stackable chair for greater versatility.

As more particularly shown in FIG. 1, the stackable chair 10 of the present preferred embodiment is a one-piece, molded plastic, stackable upright patio or lawn chair, similar in design and construction to those found in common use throughout the country, but incorporating design features making the chair unique and far more useful and versatile than the standard chair. The stackable chair 10 features a molded beverage or cup-holder 11 built into the left-hand armrest 17 for receiving a cup 20 and a plate-holder 12 built into the right-hand armrest 18 for holding a plate 12.

The stackable chair 10 of the present preferred embodiment is approximately three (3') feet in height, with a width of two (2') feet and a depth of two (2') feet; a one-piece, injection-molded thermoplastic construction which is weatherproof and UV-resistant, sturdy and durable; a rounded or angular chair back 13 with stylish slats 14, and a contoured, comfortable seat 15. At the end 16 of the left armrest 17, the stackable chair features the cup-holder 11 which is at least two (2") inches but preferably four and one-half (4½") inches in depth, with a width of at least two inches (2") and preferably about three (3") inches, and designated to hold a beer or soft-drink bottle or can, or a Styrofoam or plastic picnic cup 20. The chair's right armrest 18 terminates in the molded plate-holder 12, which is at least four (4") inches but preferably six (6") inches in diameter, and is concave and has depth of at least one-half (½") inch but preferably one and one-quarter (1¼") inches around its circumference, and sloping downward to a depth of at least one (1") inch but preferably two (2") inches at the center for accommodating and securing a paper, plastic, or Styrofoam picnic plate 21 which may also have a concave shape. An edge of the plate-holder nearest a leading front edge of the right armrest is at least two inches (2") rearwardly of a front of the right armrest.

Figure 6:
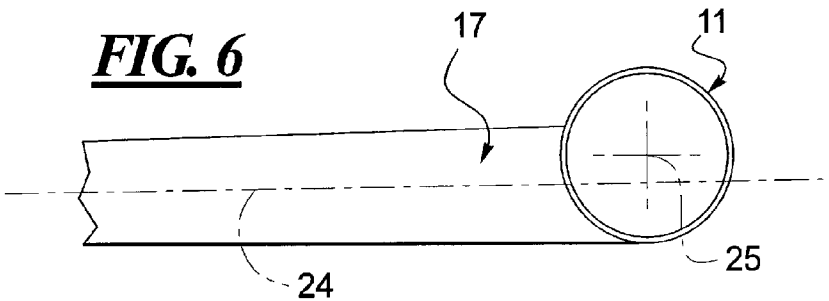
FIG. 6 is a top partial view of a cup-holder in FIG. 1.
Figure 3:
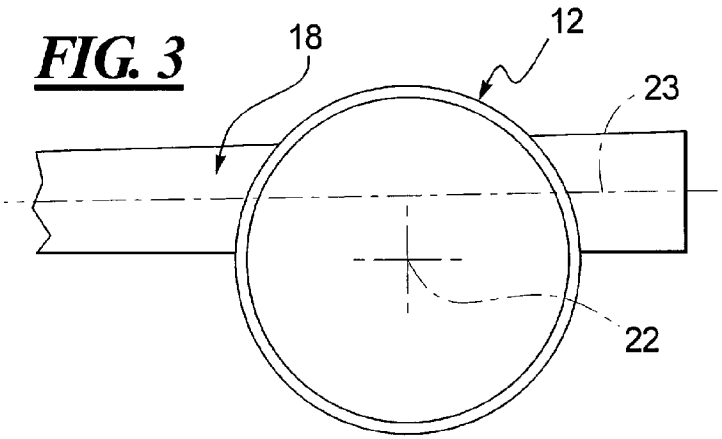
FIG. 3 is a top partial view of a plate-holder in FIG. 1.

Both the cup-holder 11 and the plate-holder 12 are positioned laterally toward the outer sides of the two armrests. As to the plate-holder 12, when viewed from the top as shown in FIG. 3, it may be observed that the central vertical axis 22 of the plate-holder 12 is outwardly of the longitudinal center line 23 of the armrest 18 by at least one-half inch (½") and preferably one inch (1"). And as to the cup-holder 11, as shown in FIG. 6, with respect to a longitudinal center line 24 of the armrest 17, a central vertical axis 25 of the cup-holder is outwardly offset by at least one-half (½") inch from this longitudinal center line 24.

Figure 5:
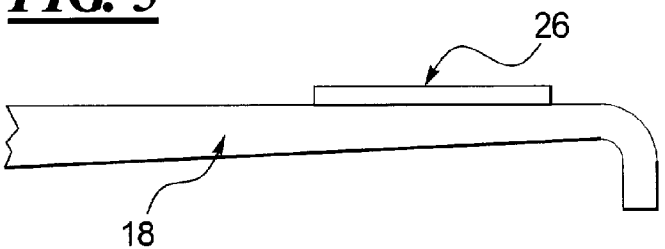
FIG. 5 is a side partial view of an alternative plate-holder.

Alternatively, as shown in the side view of FIG. 5, the plate-holder may be a planar disc 26 as illustrated. It may have a diameter of at least four inches (4") but preferably six inches (6").

Figure 4:
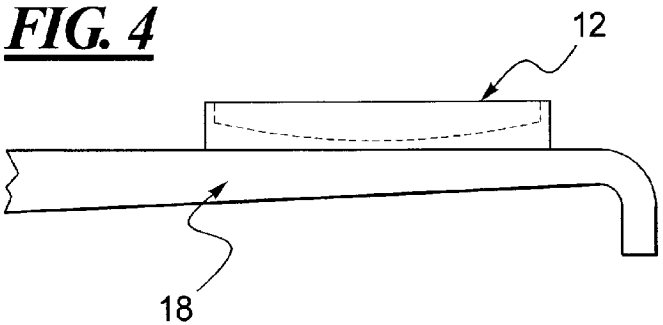
FIG. 4 is a side partial view of the plate-holder of FIG. 1.

FIG. 4 is a side partial view of the plate-holder 12 of FIG. 1 showing a concave depression.

Figure 7:
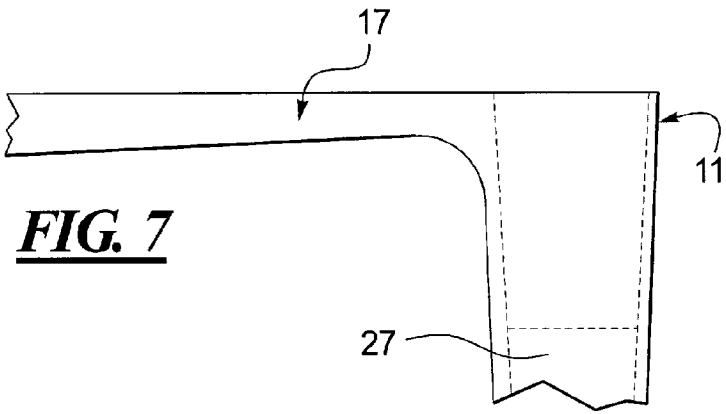
FIG. 7 is a side partial view of the cup-holder of FIG. 1

FIG. 7 is a side partial view of the beverage holder of FIG. 1.

It may be further noted that beneath the cup holder is an integral conically tapered portion 27 integral with the cup-holder. Said tapered portion 27 extends down to a bottom of the leg in tapering fashion.

The stackable chair can be produced in a variety of colors and finishes to suit the range of consumer taste. And, as shown in FIG. 2, the stackable chair 10 is shaped and dimensioned to be stackable to form a stack 100 for storage and transport, each chair nesting easily and securely atop the chair beneath it.

Preferably the stackable chair 10 is dimensioned so that when stacked, there is gap 28 between the front lower edge 29 of the upper adjacent chair and front upper edge 30 of the lower adjacent chair of no more than four inches (4") and preferably of about two inches (2").

The stackable chair 10 of the present preferred embodiment, which is a one-piece, molded plastic patio or lawn chair in which the armrests 17 and 18 have been designed to hold the disposable cups 20 and plates 21, presents a number of distinct and significant benefits and advantages. Foremost, the stackable chair 10 offers the same convenience, ease of storage and transport, and minimal expense that have made one-piece, molded plastic outdoor chairs so popular. But the drawback with all such chairs currently on the market, i.e., the lack of a place for food and drink, has been overcome with the design of the stackable chair. The chair does, in fact, hold everything that the outdoor sitter might need at a cook-out or barbecue, a community concert, or a firehouse or church supper because the chair gives the sitter a secure, ample cup-, can-, or bottle-holder 11 for the cup 20 in the left armrest 17; and the secure holder 12 for the paper or plastic picnic plate 21 in the right armrest. The chair 10 not only provides a secure place for food and drink, but also is also stackable, for the convenient storage and transport qualities that have made one-piece molded chairs such a favorite. For household consumers, for catering companies, for bars and restaurants with outside seating, for church and community groups, schools, concert venues, the chair will appeal strongly, and very likely become the standard in affordable, stackable, outdoor seating.

The foregoing exemplary descriptions and the illustrative preferred embodiments of the present invention have been explained in the drawings and described in detail, with varying modifications and alternative embodiments being possible. While the invention has been so shown, described and illustrated, it should be understood by those skilled in the art that equivalent changes in form and detail may be made therein without departing from the true spirit and scope of the invention, and that the scope of the present invention. Moreover, the invention as disclosed herein, may be suitably practiced in the absence of the specific elements which are disclosed herein.

I claim as my invention:

1. A stackable chair system, comprising:

a plurality of chairs, each chair having a back, a seat, four legs, and first and second armrests all integral with one another in an injection-molded thermal plastic construction;

each first armrest having an integral molded round non-movable cup-holder positioned in a region of an outer end of the first armrest;

each second armrest having an integral molded non-movable substantially circular plate-holder in a region of an outer end of the second armrest at an upper surface of the armrest and having a diameter substantially greater than a width of the armrest where the plate-holder is located;

the back, seat, four legs, first and second armrests, cup-holder, and plate-holder all being an integral single molded piece;

each seat being contoured downwardly forming a seat depression; and each chair being dimensioned so that the chairs can be stacked on top of one another in nested fashion.

2. The system of claim 1 wherein the first armrest is a left armrest and the second armrest is a right armrest.

3. The system of claim 1 wherein the cup-holder is integrally molded directly at an end of the first armrest.

4. The system of claim 3 wherein the cup-holder is part of a tapering conical integral molded portion having a decreasing diameter as it tapers toward a bottom end of a leg of one of said four legs of the chair beneath the first armrest.

5. The system of claim 3 wherein a central vertical axis of the cup-holder is positioned outwardly of a longitudinal center line of the first armrest.

6. The system of claim 5 wherein said central vertical axis is at least one-half (½") inch outwardly of said longitudinal center line of said first armrest.

7. The system of claim 1 wherein said plate-holder is inwardly spaced from an end of the second armrest and has a central vertical axis which is outwardly of a longitudinal center line of the second armrest.

8. The system of claim 7 wherein an edge of the plate-holder nearest the leading front edge of the second armrest is at least two inches rearwardly of a front of the second armrest.

9. The system of claim 1 wherein the plate-holder is concave.

10. The system of claim 1 wherein the plate-holder has a first depth at a periphery and tapers down to a deeper depth at a central longitudinal vertical axis of the plate-holder.

11. The system of claim 1 wherein the plate-holder is a flat, round integral disc.

12. The system of claim 1 wherein the plate-holder is round.

13. The system of claim 1 wherein each chair comprises a weather-proof, UV-resistant material.

14. The system of claim 1 wherein said chairs are dimensioned so that when they are stacked there is a gap between a front of each seat portion of adjacent chairs of no more than 4 inches.

15. A stackable chair system, comprising:

a plurality of chairs, each chair having a back, a seat, and left and right armrests all integral with one another in an injection-molded thermal plastic construction;

each left armrest has an integral molded round cup-holder for accommodating a cup and is at least 2 inches in depth and positioned such that a central vertical axis of the cup lies at least ½ inch outwardly of a longitudinal center line of the left armrest;

a round plate-holder towards an outer end of the right armrest and integrally molded thereto and having a sloping-down center having a depth at a center of at least approximately 1 inch and a depth at a circumference of at least approximately ½ inch for accommodating a food plate, said plate-holder having a central vertical axis being offset outwardly to a right of a longitudinal center line of said right armrest by at least ½ inch, and an edge of the plate-holder nearest a front end of the right armrest is set back from said front end;

said seat being contoured downwardly forming a seat depression;

each chair being dimensioned so that the chairs can be stacked on top of one another in nested fashion wherein a maximum gap between a front of each seat portion of adjacent chairs when stacked is no greater than four inches; and said cup-holder being located in a tapering conically-shaped region which extends down and terminates at a bottom of a leg extending down from said left arm rest.

* * * * *